US008108064B2

(12) United States Patent
Mukhopadhyay

(10) Patent No.: US 8,108,064 B2
(45) Date of Patent: Jan. 31, 2012

(54) SYSTEM AND METHOD FOR ON-LINE PROPERTY PREDICTION FOR HOT ROLLED COIL IN A HOT STRIP MILL

(75) Inventor: Ananya Mukhopadhyay, Jamshedpur (IN)

(73) Assignee: Tata Steel Limited, Jamshedpur (IN)

( * ) Notice: Subject to any disclaimer, the term of this patent is extended or adjusted under 35 U.S.C. 154(b) by 467 days.

(21) Appl. No.: 10/551,251

(22) PCT Filed: Mar. 26, 2004

(86) PCT No.: PCT/IN2004/000070

§ 371 (c)(1),
(2), (4) Date: Sep. 15, 2006

(87) PCT Pub. No.: WO2004/085087

PCT Pub. Date: Oct. 7, 2004

(65) Prior Publication Data

US 2007/0106400 A1 May 10, 2007

(30) Foreign Application Priority Data

Mar. 28, 2003 (IN) ..... 188/KOL/03

(51) Int. Cl.

| | |
|---|---|
| ***G06F 19/00*** | (2011.01) |
| ***B21B 37/72*** | (2006.01) |
| ***B21B 37/68*** | (2006.01) |
| ***B21B 37/58*** | (2006.01) |
| *B21B 37/48* | (2006.01) |

(52) U.S. Cl. ..... 700/150; 700/147; 700/148; 700/149; 72/8.6; 72/8.7; 72/8.8; 72/8.9; 72/10.1

(58) Field of Classification Search ..... 700/147, 700/148, 149, 150; 72/8.6, 8.7, 8.8, 8.9, 72/256, 242.4
See application file for complete search history.

(56) References Cited

U.S. PATENT DOCUMENTS

| | | | | |
|---|---|---|---|---|
| 3,253,438 | A | 5/1966 | Stringer | |
| 3,279,000 | A * | 10/1966 | Ward et al. | 164/433 |
| 3,568,637 | A | 3/1971 | Smith, Jr. | |
| 3,766,763 | A * | 10/1973 | Cofer et al. | 72/12.2 |
| 4,955,216 | A * | 9/1990 | Barker et al. | 72/13.4 |

(Continued)

FOREIGN PATENT DOCUMENTS

DE 19941600 A1 3/2001

*Primary Examiner* — Albert Decady
*Assistant Examiner* — Sunray Chang
(74) *Attorney, Agent, or Firm* — The Webb Law Firm

(57) ABSTRACT

A system for on-line property prediction for hot rolled coils in a hot strip mill of a steel plant, including a unit for capturing the chemistry from the steel making stage and providing the data on rolling schedule. Field devices are provided at the instrumentation level for measuring process parameters during hot rolling. A programmable logic controller is used for acquiring data of measured parameters from the field devices and feeding the data to a processor. Means is provided for conversion of the measured data from time domain to space domain using segment tracking. A computation module processes the converted space domain data for predicting mechanical properties along the length and through the thickness of the strip being rolled. A display unit displays the predicted properties. The data obtained can be stored in a data warehouse for future use. A unit provided in the system can collect the predicted properties and feed the same to the scheduling unit.

16 Claims, 6 Drawing Sheets

U.S. PATENT DOCUMENTS 5,047,964 A * 9/1991 Lalli ..... 702/130
5,113,678 A * 5/1992 Mannaka et al. ..... 72/8.6
5,289,867 A * 3/1994 Barker et al. ..... 164/455
5,290,370 A * 3/1994 Okada et al. ..... 148/330
5,357,663 A * 10/1994 Morioka et al. ..... 29/34 A
5,770,832 A * 6/1998 Carnes et al. ..... 219/109
6,430,461 B1 * 8/2002 Andorfer et al. ..... 700/148
6,546,310 B1 * 4/2003 Doll et al. ..... 700/150
6,866,729 B2 * 3/2005 Gramckow et al. ..... 148/511

* cited by examiner

Data Compare Between 09/10/2003 And 12/10/2003

YS Accuracy
+/- 15 Mpa

YS Reliability
75%

Total Points 152
Outside Points 38
Inside Points 114

UTS Accuracy
+/- 15 Mpa

UTS Reliability
87%

Total Points 152
Outside Points 20
Inside Points 132

%EL Accuracy
+/- 5 %

%EL Reliability
98%

Total Points 152
Outside Points 3
Inside Points 149

SYSTEM AND METHOD FOR ON-LINE PROPERTY PREDICTION FOR HOT ROLLED COIL IN A HOT STRIP MILL

BACKGROUND OF THE INVENTION

1. Field of Invention

The present invention relates to a system and method for on-line property prediction for hot rolled coil in a hot strip mill. This invention is in the area encompassing automation research and development, applied to metallurgical processes with specific reference to mechanical property of hot rolled coil.

2. Description Of Related Art

In the hot strip mill the slabs are heated and soaked at an elevated temperature (~1200° C.) in the reheat furnace, and are subjected to subsequent reduction in the roughing and finishing mill. All reductions are completed in the austenitic phase (~890° C.) before the strip enters in the run-out table (ROT). The strips are cooled down to ~600° C. by using laminar water jets on be ROT, before being cooled in the down coiler.

For determining the mechanical properties of a hot rolled coil from the hot strip mill, in accordance with the criteria mentioned in the technical delivery condition, the usual practice is to perform tensile tests of the specimen in a tensile testing machine, for example, an INSTRON machine. The specimen used for tensile testing is prepared from a cut-out sample of the outer wrap of the coil produced in the mill. The cut-out sample is then machined to prepare the specimen for tensile testing.

From the stess-strain graph generated from the tensile testing machine, the mechanical properties like Yield Strength (YS), Ultimate Tensile Strengths (UTS) and Percentage Elongation (EL) can be obtained. The test results are posted in the Test Certificate (TC) before the coil is shipped to the customer.

One drawback of this existing method is that there is only one sample per coil that can be tested since the coil cannot be cut from the module for taking the samples.

As there is no means to know the variation in property in the body of the coil, the sample is not representative of the entire coil because the sample from the outer wrap of the coil does not represent the entire length of the coil. Since the variability of properties along the length need to be within control from the point of view of application and further processing, it is important to know this variation during rolling of the hot rolled coil in the hot strip mill so that corrective and preventive action can be taken.

Because of the very nature of the cooling process for the coil, non-uniform cooling takes place along the length of the strip giving very different test results for the cut out from the end of the coil than that likely to be obtained form the body of the coil.

As the results can be obtained only after 2/3 days (time required for cooling from about 600° C. to room temperature), no corrective action can be taken during production of the hot rolled strip.

A need therefore, exists for developing an on-line system for property prediction of a hot rolled coil.

SUMMARY OF THE INVENTION

The main object of the present invention therefore is to provide an on-line system and method of property prediction over the length of hot rolled coil, as the coil is being rolled, to improve the quality and to achieve the stringent property requirements. Such on-line prediction helps the operator to take corrective actions so as to get nearly uniform mechanical properties along the length of the strip.

The system captures the chemistry of the hot rolled coil from the steel making stage and the process parameters during the hot rolling stage. The system then calculates in real time the mechanical properties, likely to be obtained in cold condition after cooling along the length and also across the thickness of the strip being rolled. It also predicts the condition of aluminium nitride after cooling, which in turn gives the forming properties of cold rolled coils after batch annealing.

The system may include parameters for grades of steel such as low carbon steel, grades D (Drawing), DD (Deep Drawing), EDD (Extra Deep Drawing) and steel for cold rolling. The accuracy of the system can be ±15 Mpa. The reliability can be as high as 85%.

Thus, the present invention provides a system of on-line property prediction for hot rolled coils in a hot strip mill comprising a unit for providing data on rolling schedule with chemistry from the steel making stage; field devices for measuring process parameters during hot rolling; a programmable logic controller for acquiring data of measured parameters from said field devices and feeding said data to a processor; means for conversion of the measured data from time domain to space domain using segment tracking; a computation module for processing said converted space domain data for predicting mechanical properties along the length and through the thickness of the strip being rolled; and a display unit for on-line display of the predicted properties.

BRIEF DESCRIPTION OF THE ACCOMPANYING DRAWINGS

DETAILED DESCRIPTION OF THE PREFERRED EMBODIMENTS

The present invention will now be described in detail with the help of the figures of the drawings.

Figure 1:
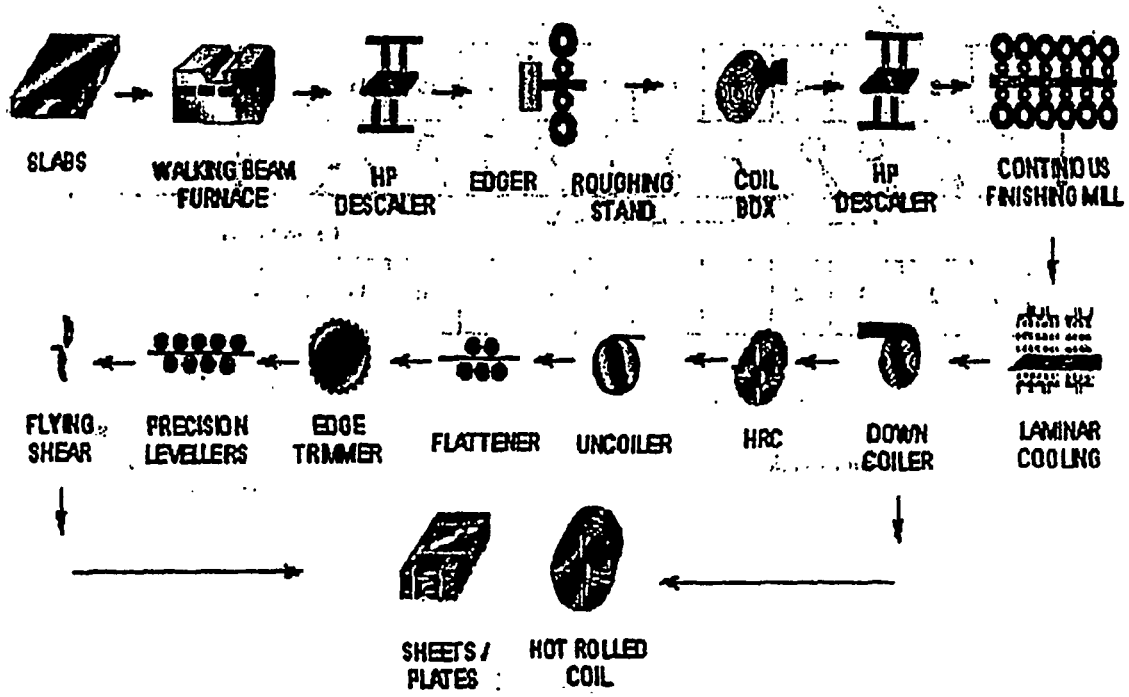
FIG. 1 shows the process flow of the present invention in a hot strip mill.

In FIG. 1 the hot strip mill of the present invention in a steel plant has been depicted where strips are produced from the slab. The slabs of 210 mm thick are heated at an elevated temperature of ~1200° C. in the reheat furnace, and are soaked for sufficiently long time so as to obtain fairly uniform temperature all through. The slabs are then rolled in successive posses at the roughing and finishing mill to obtain desired strip thickness. Usually all the deformation is given in the austenitic phase (~890° C.) before the strip is cooled on the run-out table. The strip is then cooled on the run-out table using laminar water jets to about ~600° C. when it coiled in the down-coiler. The run-out table is an important part of the hot strip mill since the entire metallurgical transformation takes place in this region. The austenitic phase is transformed to ferritic stage.

Figure 2:
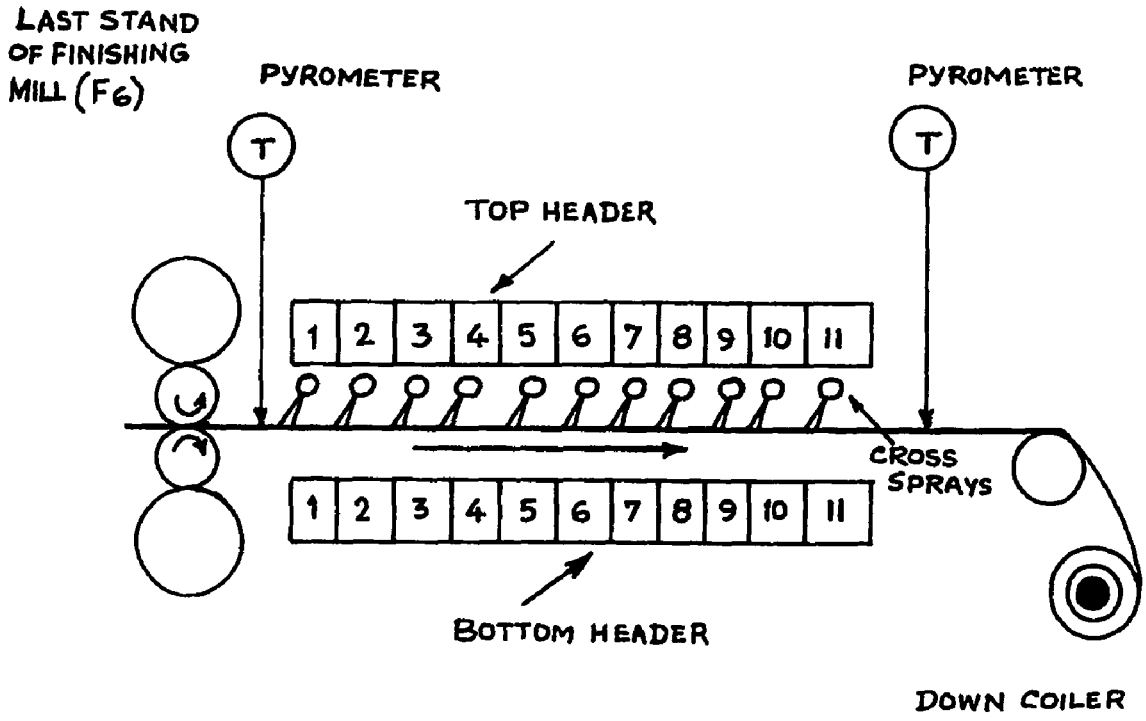
FIG. 2 shows a schematic diagram of a run-out table of the present invention in a hot strip mill.

FIG. 2 depicts the schematic of run-out table where the strips, after finish rolling in the austenitic range (~890° C.), are cooled with water before coiling in the down coiler. The coiling temperature varies between 580-700° C. depending on steel grades produced. During cooling, austenite is transformed to ferrite, pearlite, bainite and martensite depending on the cooling rate. The cooling rate and coiling temperature determines the ferrite grain size, and in turn the mechanical properties. The mechanical properties are determined primarily by ferrite grain size, volume fraction, interlamellar spacing of the pearlite, the size and distribution of precipitates etc., in the cooled strip. The rate of cooling is obtained from the temperature profile. A high rate of heat removal or high temperature gradient through the strip thickness may produce inhomogenity in through thickness microstructure and also in mechanical properties. Hence the rate of cooling of the hot rolled steel on the run-out table is a determining factor to the final properties.

The run-out table may comprise a total of about eleven water banks for cooling by water from the top and bottom. The first cooling bank is located at a distance of 10 meter from the last finishing stand. Out of eleven banks, the first ten are macro-cooling banks and the last one is micro-cooling bank. There is a small difference in cooling efficiency of top and bottom cooling.

Figure 3:
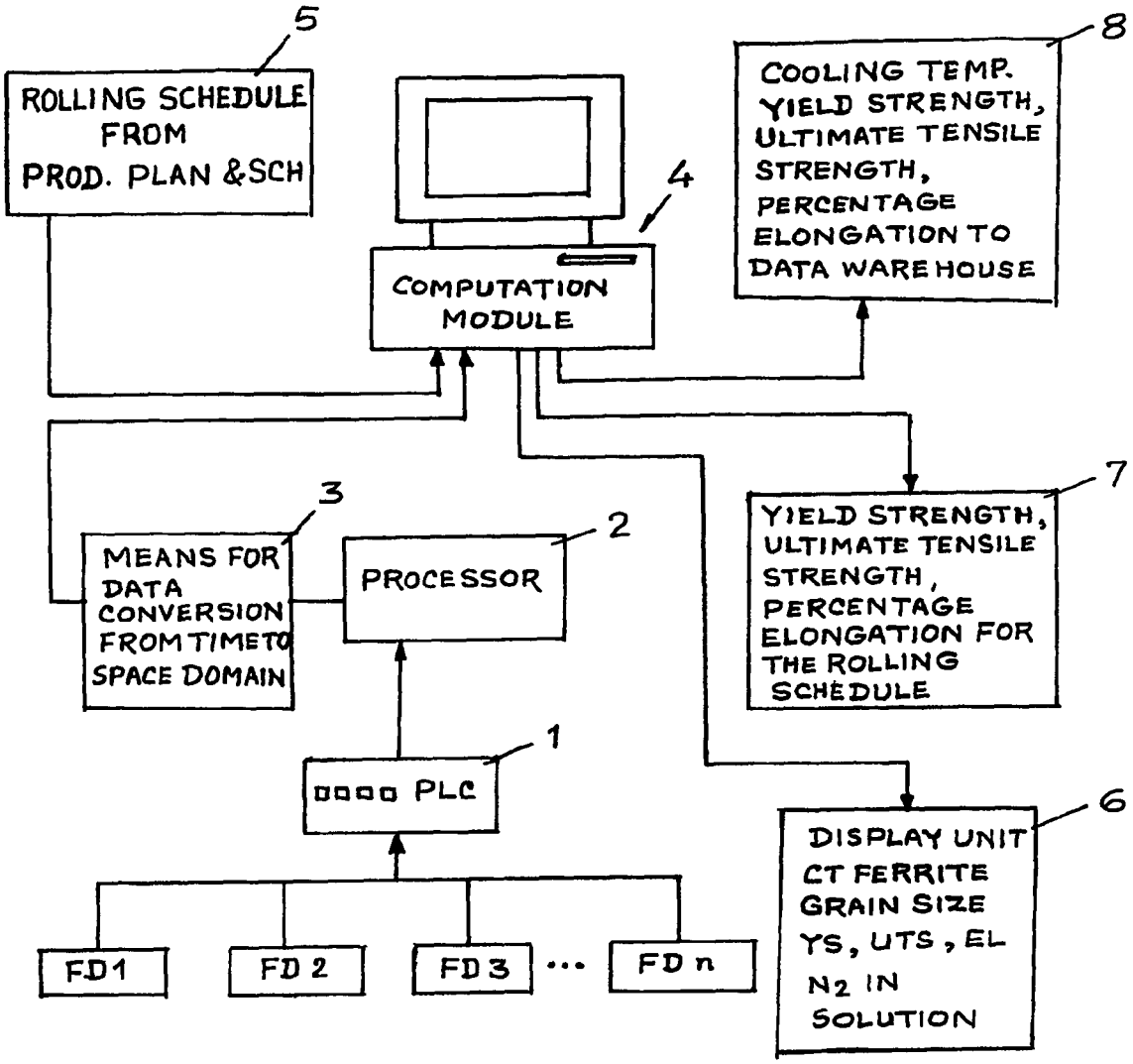
FIG. 3 shows a schematic diagram for the system of the present invention.

FIG. 3 shows a schematic diagram of the system. The data flows from the instrumentation and field devices level (level O) upwards. These field devices FD1 to FDn obtain real time process related data such as pyrometers, tachometers, solenoid valves etc. From a unit in level 3 represented by reference numeral 5 in FIG. 3, the data on rolling schedule with chemistry from the steel making stage are fed to a computation module 4 for processing.

The captured data from the field devices FD1 to FDn are moved upwards of level 1 comprising mill control system. The data comprising measurement parameters from the field devices FD1 to FDn are acquired by a programmable logic controller 1 and fed to a processor 2 in level 2 process control system) for processing. The programmable logic controller 1 like a PLC 26 made by Westinghouse is connected to the field devices through coaxial cable using remote I/O. For capturing data every 0.01 sec, a WESTNET I Data highway with Daisy Chain Network topology can be used.

The data transfer between the programmable logic controller 1 and the processor 2 can be done through WESTNET II using coaxial cable with Token Pass Network topology. Processor 2 can be an Alstom VXI 186.

The time domain data from processor 2 are converted to a space domain data through segmentation, with the help of means 3 for conversion of data provided in the system. The output from means 3 comprising finish rolling temperature (FRT), lower cooling temperature (CT), rolling speed, cooling condition for a given position on the strip are provided as input to a computation module 4.

The segment tracking carried out by means 3 for conversion of data will now be explained.

The on-line data regarding the finish rolling temperature (FRT), speed of the strip and the signal of the valve status (opening/closing), the actual cooling temperature (CT) are obtained from the processor 2. The cooling of strip on run-out table (ROT) is a dynamic process. The objective of finish rolling is to roll the entire length of the strip in the austenitic range. To attain this temperature, the operator needs to change the speed of rolling. On the other hand, the objective of cooling is to maintain a constant cooling rate and a constant cooling temperature (CT). This means with the increase in speed, the more number of headers are required to be made on and with decrease in speed the more number of headers are to be made off. Thus, a steady state cooling is activated.

Therefore, the process data that is collected every second during the whole cooling process (~1.5-2 min) shows variation of speed and variation of number of header opening. This is the time domain data. To make it space domain to obtain the finish rolling temperature (FRT), the amount of water required cooling the strip ie. the number of header opening, sequencing of header pattern, the total strip length on run-out table is divided into some segments and each segment is tracked to obtain the process history. This process of conversion is called segment tracking and this segmenetal file with records converted from time to space domain is fed as an input to on-line model.

The system predicts coiling temperature over the entire length of the coil. It also shows the average value of coiling temperature for the coil. The actual values of the coiling temperature are also shown for comparison. An accurate match ensures that the cooling rate calculated from the model at any point over the length is accurate enough the purpose of prediction of ferrite grain size.

Ferrite grain size ($d\alpha$) variation over the length of the coils is shown along with its average and tail end value. The latter can easily be verifed through metallographic analysis from the specimen taken from the outer wrap of the coil produced in hot strip mill.

Hot rolled coil used for cold-rolled applications are processed through cold rolling mill. For aluminium-killed drawing quality steel it is important to have aluminium and nitrogen in complete solid solution in the hot rolled coil after coiling for better formability of cold rolled coil. The formation of aluminium nitride precipitate before batch annealing is detrimental and its formation is avoided by choosing higher finish rolling temperature (FRT) followed by lower coiling temperature (CT). Aluminium nitride precipitate is desirable in batch annealing stage where recrystallization is guided by aluminium nitride precipitates, thereby achieves high r-bar (plastic strain ratio) and n (work hardening exponent).

The system predicts the amount of aluminium and nitrogen in solid solution over the length of the coil. This prior information to cold rolling mill (CRM) helps take corrective actions in further processing.

The system predicts variation of yield strength, ultimate tensile strength and % elongation over the entire length of the coil, along with its average and tail end value. The latter is verified with the actual value obtained from mechanical testing of the specimen prepared from the outer wrap of the coil.

The system predicts ferrite grain size, aluminium and nitrogen in solution, yield strength, ultimate tensile strength and % elongation not only along the length but also through the thickness at three different locations—center, surface and quarter thickness.

The tolerance limits specified by the customers in the Technical Delivery Conditions (TDC) are also shown on the display screen.

Figure 5:
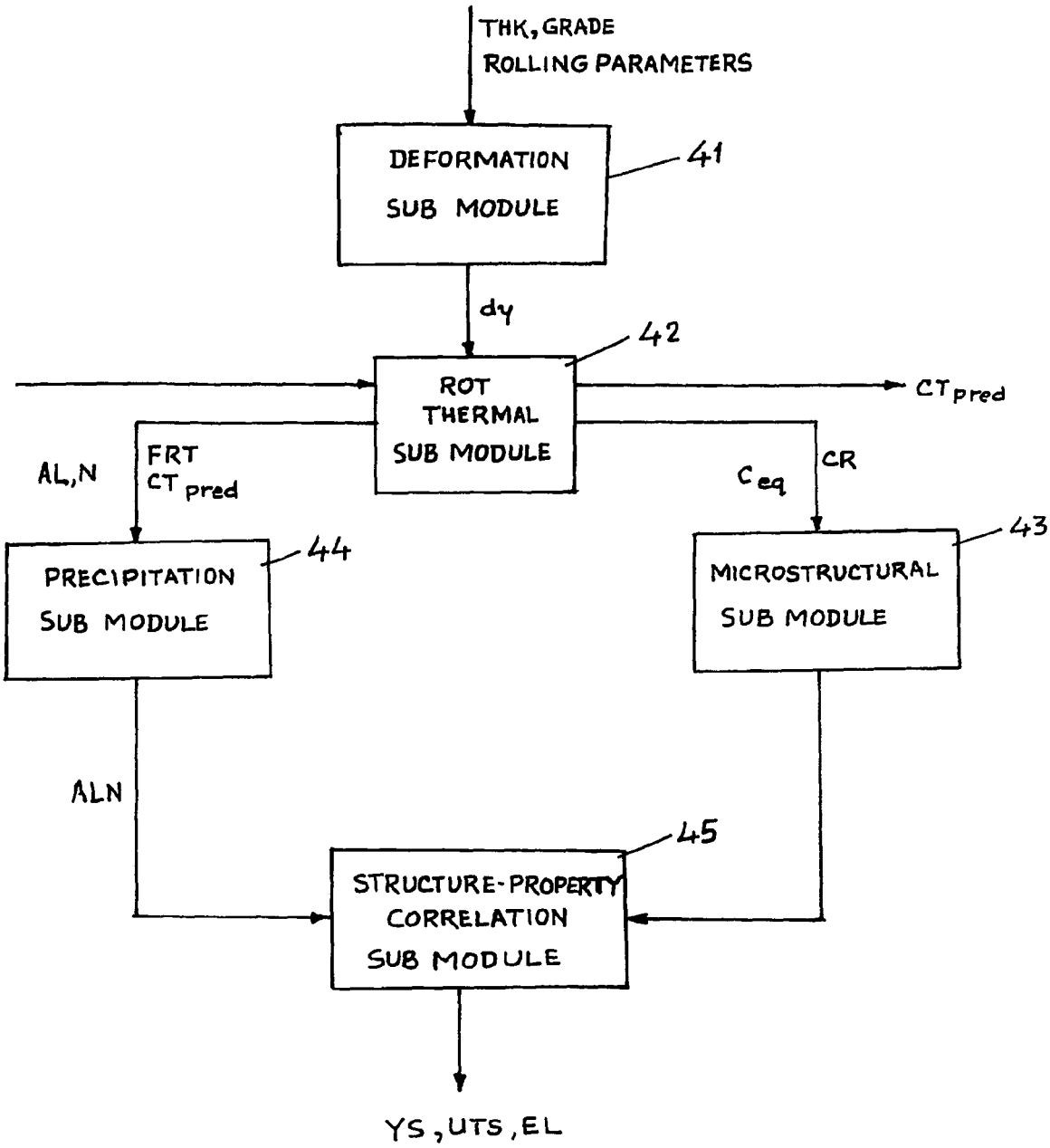
FIG. 5 shows the sub-modules provided in a computation module of the present invention

As shown in FIG. 5, the computation module 4 comprises five sub-modules, namely, deformation sub-module 41, thermal sub-module 42, microstructural sub-module 43, precipitation sub-module 44 and structure property correlation sub-module 45.

Deformation sub-module 41 determines final austenite grain size finish rolling.

The final austenite grain size depends on strain (reduction per pass), strain rate (speed of deformation), and temperature of deformation, inter-pass time etc.

Thermal sub-module 42 determines temperature drop during radiation in air and, cooling in water at run-out table. It calculates the cooling rate, which determines the recrystallisation behaviour and the phase transformation.

Microstructural sub-module 43 determines the microstructural changes during phase transformation.

For low carbon aluminium killed steel used for further cold rolling and anealing, the amount of aluminium and nitrogen in solid solution in hot rolling stae plays a vital role in formability properties of cold rolled sheet.

Precipitation sub-module 44 determines the amount of aluminium and nitrogen in the solid solution and also as precipitates after coiling.

The structure-property correlation sub-module 45 calculates the yield strength (YS). ultimate tensile strength (UTS) and percentage elongation (EL) based on the phases present.

Figure 4:
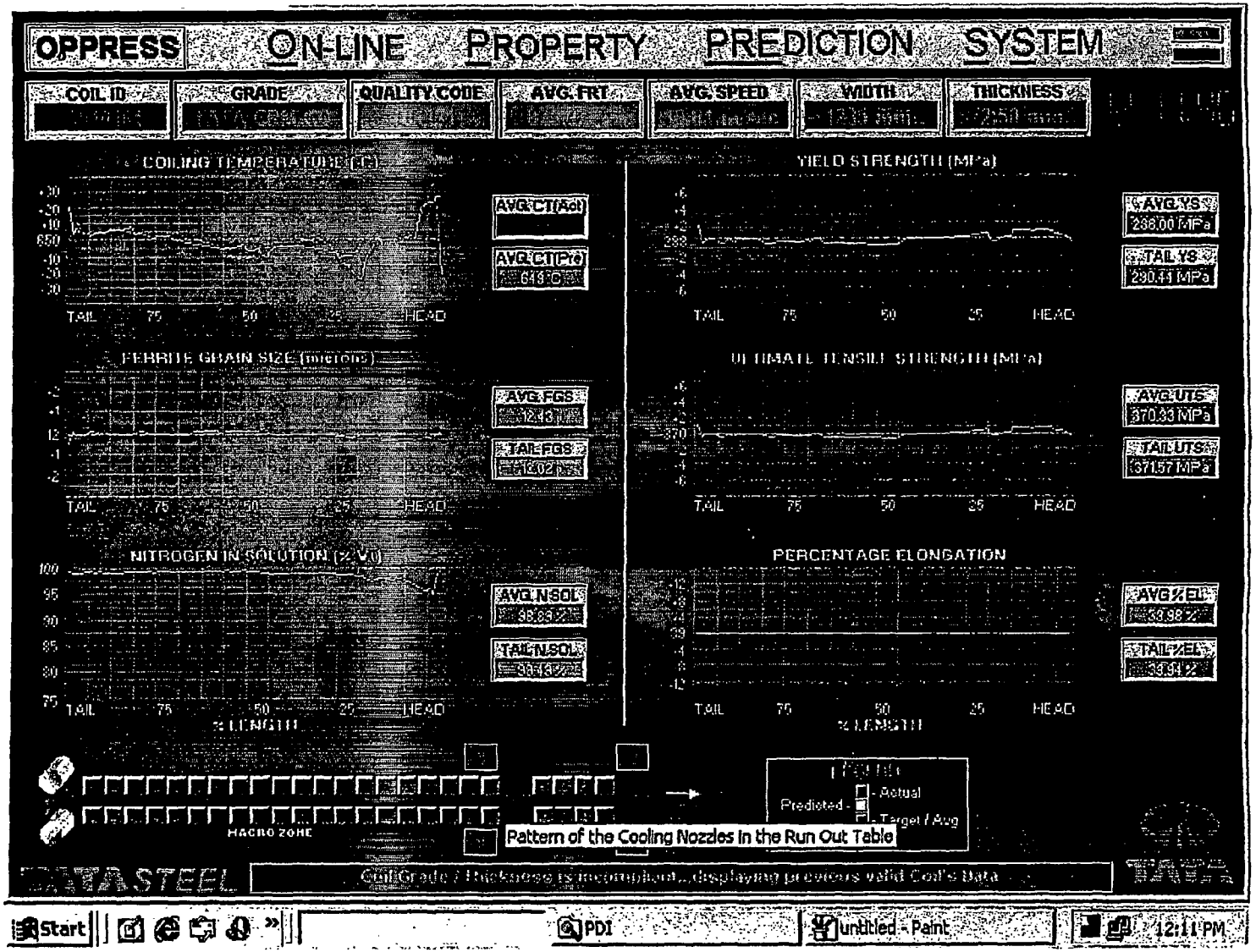
FIG. 4 shows the system output displayed on a CRT screen

The output of the system gives cooling rate, volume fraction of aluminium nitride, and the mechanical properties (YS, UTS, EL) over the length and through the thickness of the coil. These are displayed on a display unit 6 for every coil at various positions of the strip as shown in FIG. 4. The predicted coiling temperature is also shown vis-a-vis the actual in order to ensure that the predicted cooling rate (CR) to achieve the CT as obtained from the thermal sub-module is accurate enough. Apart from these, the average values over the length are also calculated. The properties of the tail-end of the coil (outer wrap) is also displayed since this can directly be verified from the tensile testing results of the specimen taken from the coil.

The predicted data outputted from the computation module 4 on the mechanical property along the length and through the thickness of the strip being rolled are stored in a unit 7 for use by the scheduling unit 5 at production planning and scheduling level.

The data for each coil so generated are stored in the system and, are sent to the data warehouse 8 where they are stored for future use.

Figure 6:
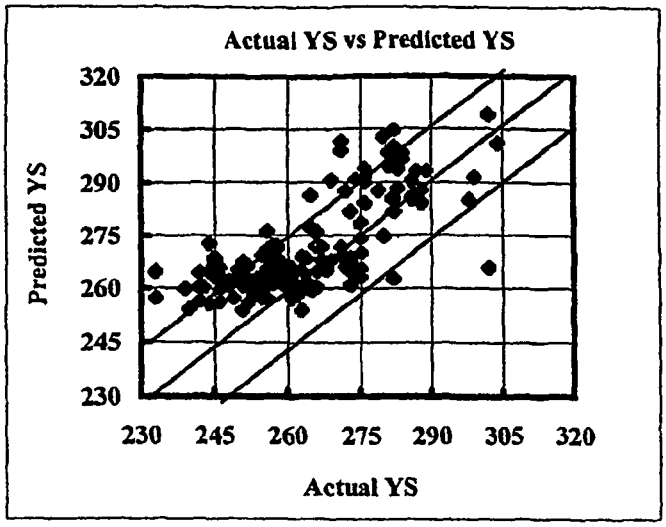
FIG. 6 shows comparison between predicted data obtained before and after the three days cooling period
Figure 6:
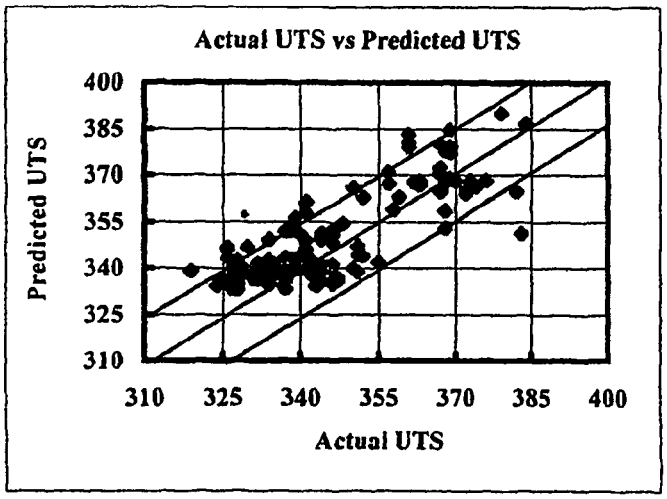
Figure 6:
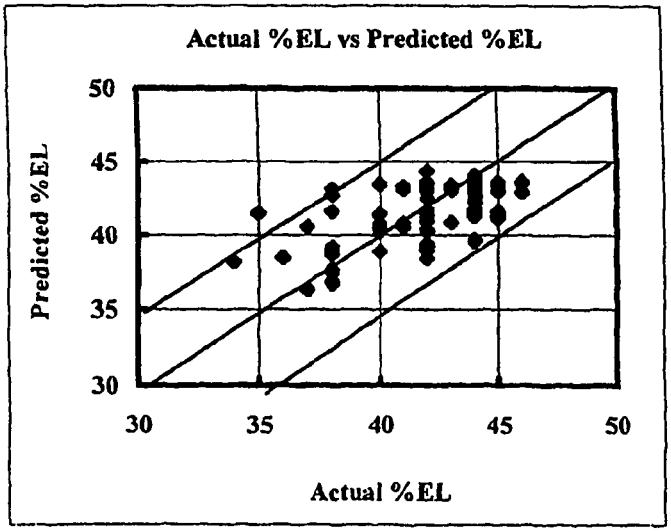

FIG. 6 shows a comparison between the predicted data on yield strength (YS), ultimate tensile strength (UTS) and percentage elongation (EL) obtained before and after the cooling period of three days.

I claim:

1. A system for on-line display of property prediction for hot rolled coils in a hot strip mill comprising:

a unit for providing data on rolling schedule with chemistry from the steel making stage;

one or more field devices for measuring process parameters during hot rolling;

a programmable logic controller for acquiring data of measured parameters from said field devices and transmitting said data parameters to a processor;

segment tracking means for converting the measured data from time domain to space domain using segment tracking, wherein a total length of a strip being rolled is divided into a plurality of segments, process history data are tracked and collected in each of the plurality of segments as the strip moves through the strip mill and the process history data are stored as a segmental file;

a computation module for processing said segmental file for predicting mechanical properties along the length and through the thickness of the strip being rolled; and a display unit for displaying the average coiling temperature and a plurality of actual values of the coiling temperatures at any point over the length for comparison for determining accuracy and displaying predicted values for each segment, the values being one or more of a cooling temperature, ferrite grain size, yield strength, ultimate tensile strength, percentage elongation and nitrogen in solid solution/precipitate, so preventive and corrective action can be taken during rolling.

2. The system as claimed in claim 1, wherein said field devices include one or more of a pyrometer, a speedometer, a thickness gauge, and a solenoid valve for measuring data on process parameters.

3. The system as claimed in claim 2, wherein said programmable logic controller is configured to capture data from said field devices over 0.01 sec. using WESTNET I data highway with Daisy Chain Network topology.

4. The system as claimed in claim 3, wherein said processor is an ALSTOM VXI 186 processor and the data transfer between said processor and said programmable logic controller is through WESTNET II using coaxial cable with Token Pass Network topology.

5. The system as claimed in claim 3, wherein the system includes a display unit for displaying one or more of a cooling temperature, ferrite grain size, yield strength, ultimate tensile strength, percentage elongation and nitrogen in solid solution/precipitate.

6. The system as claimed in claim 2, wherein said computation module includes a deformation sub-module for determining final austenite grain size after finish rolling.

7. The system as claimed in claim 1, wherein said programmable logic controller is a Westinghouse PLC 26 connected to said field devices through coaxial cable using remote I/O.

8. The system as claimed in claim 1, wherein said processor is an ALSTOM VXI 186 processor and the data transfer between said processor and said programmable logic controller is through WESTNET II using coaxial cable with Token Pass Network topology.

9. The system as claimed in claim 1, wherein said computation module includes a deformation sub-module for determining final austenite grain size after finish rolling.

10. The system as claimed in claim 1, wherein said computation module includes a thermal sub-module for determining the temperature drop during radiation while cooling said hot rolled strip.

11. The system as claimed in claim 10, wherein the system includes a data warehousing device for storing the data generated by said computation module.

12. The system as claimed in claim 1, wherein said computation module includes a microstructural sub-module for determining microstructural changes during phase transformation.

13. The system as claimed in claim 1, wherein said computation module includes a precipitation sub-module for determining an amount of aluminium nitrogen in a solid solution and in precipitates after cooling.

14. The system as claimed in claim 1, wherein said computation module includes a structural property correlation sub-module for calculating a yield strength, ultimate tensile strength and percentage elongation based on the phases present.

15. The system as claimed in claim 1, wherein the system includes a data warehousing device for storing the data generated by said computation module.

16. The system as claimed in claim 13, wherein the system includes a data warehousing device for storing the data generated by said computation module.

* * * * *

UNITED STATES PATENT AND TRADEMARK OFFICE

CERTIFICATE OF CORRECTION

PATENT NO. : 8,108,064 B2
APPLICATION NO. : 10/551251
DATED : January 31, 2012
INVENTOR(S) : Ananya Mukhopadhyay It is certified that error appears in the above-identified patent and that said Letters Patent is hereby corrected as shown below:

Column 6, Line 60, Claim 16, “claimed in claim 13” should read -- claimed in claim 1 --

Signed and Sealed this
First Day of May, 2012

David J. Kappos

David J. Kappos
*Director of the United States Patent and Trademark Office*